US006461202B2

(12) United States Patent
Kline

(10) Patent No.: US 6,461,202 B2
(45) Date of Patent: Oct. 8, 2002

(54) TERMINAL MODULE HAVING OPEN SIDE FOR ENHANCED ELECTRICAL PERFORMANCE

(75) Inventor: Richard Scott Kline, Mechanicsburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/772,642

(22) Filed: Jan. 30, 2001

(65) Prior Publication Data

US 2002/0102885 A1 Aug. 1, 2002

(51) Int. Cl.[7] ..... H01R 13/502
(52) U.S. Cl. ..... 439/701; 439/608
(58) Field of Search ..... 439/701, 608

(56) References Cited

U.S. PATENT DOCUMENTS

| | | | | |
|---|---|---|---|---|
| 5,066,236 A | | 11/1991 | Broeksteeg | |
| 5,620,340 A | | 4/1997 | Andrews | |
| 5,664,968 A | | 9/1997 | Mickievicz | |
| 5,795,191 A | * | 8/1998 | Preputnick et al. | 439/608 |
| 5,993,259 A | * | 11/1999 | Stokoe et al. | 439/608 |
| 6,123,586 A | * | 9/2000 | MackDougall | 439/701 |
| 6,174,202 B1 | * | 1/2001 | Mitra | 439/608 |
| 6,231,391 B1 | * | 5/2001 | Ramey et al. | 439/608 |
| 6,238,245 B1 | * | 5/2001 | Stokoe et al. | 439/608 |
| 6,146,202 A1 | * | 11/2001 | Ramey et al. | 439/608 |

FOREIGN PATENT DOCUMENTS

WO WO 01/29931 A1 4/2001

* cited by examiner

*Primary Examiner*—P. Austin Bradley
*Assistant Examiner*—Edwin A. León

(57) ABSTRACT

A connector assembly is provided having a receptacle connector mateable with a header connector. The assembly includes an insulated housing and a plurality of terminal modules mounted to the insulated housing. The terminal modules have an insulated molded body enclosing multiple connector contacts having opposed mating portions. The terminal module further includes receptacle contacts and leads connected thereto for carrying signals through the terminal module. A differential shell is mounted to the terminal module and has an open sided chamber formed therein. The differential shell includes walls that define the chamber and receive the receptacle contacts. Each chamber includes an open front and open rear ends and includes at least one open side. Each chamber accepts a corresponding receptacle contact through the open side thereof. The walls of the differential shells have non-linear contours that substantially conform to a contour of the receptacle contacts to reduce the air gap therebetween and reduce the impedance of the terminal contact, thereby improving signal performance.

20 Claims, 6 Drawing Sheets

TERMINAL MODULE HAVING OPEN SIDE FOR ENHANCED ELECTRICAL PERFORMANCE

BACKGROUND OF THE INVENTION

The preferred embodiments of the present invention generally relate to an electrical connector assembly having a receptacle connector mateable with a header connector, in a small envelope and with high signal performance characteristics.

It is common, in the electronics industry, to use right angled connectors for electrical connection between two printed circuit boards or between a printed circuit board and conducting wires. The right angled connector typically has a large plurality of pin receiving terminals and, at right angles thereto, pins (for example compliant pins) that make electrical contact with a printed circuit board. Post headers on another printed circuit board or a post header connector can thus be plugged into the pin receiving terminals making electrical contact there between. The transmission frequency of electrical signals through these connectors is very high and requires not only balanced impedance of the various contacts within the terminal modules to reduce signal lag and reflection but also shielding between rows of terminals to reduce crosstalk.

Impedance matching of terminal contacts has already been discussed in U.S. Pat. Nos. 5,066,236 and 5,496,183. Right angle connectors have also been discussed in these patents, whereby the modular design makes it easy to produce shorter or longer connectors without redesigning and tooling up for a whole new connector but only producing a new housing part into which a plurality of identical terminal modules are assembled. As shown in the '236 patent, shielding members can be interposed between adjacent terminal modules. An insert may be used to replace the shield or a thicker terminal module may be used to take up the interposed shielding gap if the shielding is not required. The shield disclosed in the '236 patent is relatively expensive to manufacture and assemble. The shielded module disclosed in the '183 patent includes a plate-like shield secured to the module and having a spring arm in the plate section for electrically engaging an intermediate portion of a contact substantially encapsulated in a dielectric material. The shield arrangement of the '183 patent, however, requires sufficient space between adjacent through-holes of the board to avoid inadvertent short circuits. Furthermore, both the insulated module and the shield must be modified if the ground contact is to be relocated in the connector.

An alternative electrical connector assembly has been proposed in U.S. Pat. No. 5,664,968, in which each terminal module has a plurality of contacts including a mating contact portion, a connector connecting portion and an intermediate portion there between with some or all of the intermediate portions encapsulated in an insulated web. Each of the modules has an electrically conductive shield mounted thereto. Each shield includes at least a first resilient arm in electrical engagement with a selected one of the contacts in the module to which the shield is mounted and at least a second resilient arm extending outwardly from the module and adapted for electrical engagement with another selected contact in an adjacent terminal module of the connector assembly.

Conventional connector assemblies, such as in the '236, '183 and '968 patents, are typically designed for use both in single ended applications as well as in differential pair applications. In single ended applications, the entire signal is directed in a first direction along one conductor and then the entire signal is subsequently returned in the opposite direction along a different conductor. Each conductor is connected to a contact within a connector assembly, and thus the entire signal is directed in a first direction through one pin or contact and in the opposite direction through a separate pin or contact. In differential applications, the signal is divided and transmitted in the first direction over a pair of conductors (and hence through a pair of contacts or pins). The return signal is similarly divided and transmitted in the opposite direction over the same pair of conductors (and hence through the same pair of pins or contacts).

The differences in the signal propagation path of single ended versus differential pair applications cause differences in the signal characteristics. Signal characteristics may include impedance, propagation delay, noise, skew, and the like. The signal characteristics are also effected by the circuitry used to transmit and receive the signals. The circuitry involved in transmitting and receiving signals entirely differs for single ended and differential. applications. The differences in the transmit and receive circuitry and the signal propagation paths yield different electrical characteristics, such as for impedance, propagation delay, skew and noise. The signal characteristics are improved or deteriorated by varying the structure and configuration of the connector assembly. The structure and configuration for connector assemblies optimized for single ended applications differ from connector assemblies optimized for use in differential pair applications.

Heretofore, it has been deemed preferable to offer a common connector assembly useful in both single ended and differential pair applications. Consequently, the connector assembly is not optimized for either applications. A need remains for a connector assembly optimized for differential pair applications.

Moreover, most connector assemblies must meet specific space constraints depending upon the type of application in which the connector assembly is used while maintaining high signal performance. By way of example only, certain computer specifications, such as for the Compact PCI specification, define the dimensions for an envelope in which the connector assembly must fit, namely an HM-type connector which represents an industry standard connector. However, the HM connector does not necessarily offer adequate signal performance characteristics desirable in all applications. Instead, in certain applications, higher signal characteristics may be preferable, such as offered by the HS3 connector offered by Tyco Electronics Corp.

However, certain conventional connectors that offer higher signal characteristics may not satisfy the envelope dimensions of an HM type connector standard. For example, an HM connector is designed to be mounted on the edge of a printed circuit board to connect the printed circuit board at a right angle to a daughter card. The HM connector includes a mating face that straddles the edge of the printed circuit board. The side of the HM connector is L shaped and affords a mating face located both above and below the printed circuit board surface. The contacts on an HM connector are staggered to straddle the edge of the printed circuit board. Certain types of connectors that offer high signal characteristics include contacts only along one side of the board, not staggered on either side of a printed circuit board.

By way of example only, certain conventional connectors, such as the HS3 connectors, include ground shields and signal contact terminals. The ground shields are located in the header connector and engage ground contacts in the receptacle connector when the header and receptacle connectors are Joined. When mating the header and receptacle, it is preferable that the ground contact and ground shields engage one another before signal contacts in the header and receptacle engage one another.

However, in conventional connector assemblies, in order for tips of the ground contacts to engage the tips of the ground shields first, they should be longer than the signal contacts. The ground contacts and shields touch, when the header and receptacle are only partially mated. As the header and receptacle are further joined to the fully mated position, the point of connection between the tip of the ground contact and the ground shield moves from the tip of the ground shield toward the base of the ground shield. When fully mated, the tip of the ground contact is in electrical contact with the ground shield at a point proximate the base of the ground shield.

The signal performance is inferior for connector assemblies, in which the ground contact electrically engages the ground shield only proximate the base of the ground shield since the outer portion of the ground shield functions as a stub antenna to transmit electromagnetic (EM) interference. The EM interference caused by the ground shield interferes with the signal characteristics of the connector assembly.

Further, controlling the impedance within a connector assembly typically enhances the electrical performance of the connector assembly. In general, as the walls of the cavities of the receptacle housing are located closer to the contact the impedance is decreased. Therefore, it is preferable that the cavity walls be located close to the contact. The contours of the cavity walls of conventional connector assemblies, however, do not correspond with the contour of the contact. Instead, conventional connector housings define a cavity bounded by relatively straight walls. Therefore, the interior cavities of current receptacle housings are approximately cube-shaped. The contact is generally inserted through one end of the cube Consequently, if a non-cube, non-square, or non-rectangular shaped contact is utilized, the interior surfaces of the cavity walls do not follow the contours of the contact. Because the contours of the cavity walls do not correspond to the contours of the contact, a relatively large amount of air surrounds the contact within the cavity. The relatively large amount of air surrounding the contact produces impedance. That is, impedance increases as more air surrounds the contact which, in turn, reduces signal performance.

A need remains for an improved connector assembly capable of satisfying small envelope dimensions, while affording high quality signal performance characteristics.

BRIEF SUMMARY OF THE INVENTION

At least one preferred embodiment of the present invention provides an electrical connector assembly having a receptacle connector mateable with a header connector in a small envelope while affording high quality signal performance. The assembly includes an insulated housing and a plurality of terminal modules mounted to the insulated housing. Each terminal module has an insulated molded body enclosing multiple connector contacts having opposed mating portions. Each terminal module includes contacts formed into at least one differential pair.

In accordance with at least one alternative embodiment, a terminal module is provided that is mountable to an insulated housing of an electrical connector. The terminal module includes receptacle contacts and leads connected thereto for carrying signals through the terminal module. The terminal module also includes a differential shell having an open-sided chamber formed therein. The differential shell includes walls defining-chambers that receive the receptacle contacts. Each chamber may have open front and open rear ends and have at least one open side. Each of the chambers accepts a corresponding receptacle contact through the open side thereof. The walls of the differential shells have non-linear contours along the interior surfaces that substantially conform to a contour of the receptacle contacts received therein.

In accordance with at least one alternative embodiment, each differential shell is provided with a floor, sidewalls and a center wall. At least one of the floor, sidewalls and center wall include a non-linear, curved surface following a contour of a corresponding surface of an associated receptacle contact. The differential shells may include an open top sidewall. The chamber may include interior surfaces forming a curved contour that closely follows and substantially conforms to exterior surfaces of the receptacle contacts. The receptacle contacts may be formed in a fork shape with a flared base and fingers located closer to one another than to the flared base. The walls of the differential shell may substantially conform to outer surfaces of the fingers.

In accordance with at least one alternative embodiment, a terminal module is provided that is mountable to an insulated housing of an electrical connector, in which the terminal module includes a differential shell and receptacle contacts. The differential shell includes an open-sided cavity therein. The receptacle contacts have exterior surfaces that, when received in the open-sided cavity, conform to interior surfaces thereof. The differential shell includes side walls defining the open-sided cavity that have projections formed on interior surfaces thereof to cooperate with the sidewalls to substantially conform to a contour of the receptacle contacts.

In accordance with at least one alternative embodiment, the terminal module includes a lead frame that includes leads arranged in at least two differential pairs of leads. Each lead includes board contacts and receptacle contacts at opposite ends thereof. The receptacle contacts and the board contacts are interconnected through intermediate conductive portions of the leads. Optionally, the lead frame may include four differential pairs of conductive leads, with each conductive lead having board contacts and receptacle contacts at opposite ends thereof. The receptacle contacts and board contacts may be interconnected through intermediate conductive portions.

Optionally, the one sided cavity of the terminal module may include a floor, sidewalls, a center wall, flared portions and ramp blocks that define a contour of the open-sided cavity.

The receptacle contacts may be inserted into the differential shell through an open side thereof to enhance electrical performance by enabling the receptacle contacts to be closely spaced to inner surfaces of the open-sided cavity. The receptacle contacts may be located at a terminal end of a lead that passes through an open rear end of an associated differential shell.

In accordance with at least one alternative embodiment, an electrical connector assembly is provided having a receptacle connector mateable with a header connector operable in at least differential pair applications. The electrical connector assembly includes an insulated housing and a plurality of terminal modules mounted to the insulated housing. Each terminal module may include an insulated body enclosing multiple signal conductors with signal contacts on opposed ends thereof. The signal conductors and contacts may be formed in differential pairs. The terminal module also further includes a plurality of open-sided differential shells formed within the terminal module and receptacle contacts that conform to an inner cavity within the differential shell. Each differential shell includes walls with non-linear interior surfaces that define an open-sided cavity conforming to a contour of the receptacle contacts. The differential shells receive the receptacle contacts through the open side of the cavity.

In accordance with yet a further alternative embodiment, the insulated housing includes insulated walls that close the open-sided differential shells when the terminal modules are inserted into the insulated housing. Optionally, the insulated housing may include a plurality of support posts that cooperate to define a plurality of slots. Each slot receives one of the terminal modules. The support posts are spaced apart from one another to form, along each row of support posts, a series of gaps therebetween. The insulated housing includes thin insulating walls filling the gaps between the support posts. Optionally, a plurality of ground terminals may be located within each terminal module immediately adjacent an open side of each differential shell. The insulated housing may arrange the insulated walls to be accepted between the ground terminals and the open sides of the differential shells to form an insulative layer between the ground terminals and the receptacle contacts.

BRIEF DESCRIPTION OF THE DRAWINGS

The foregoing summary, as well as the following detailed description of the preferred embodiments of the present invention, will be better understood when read in conjunction with the appended drawings. For the purpose of illustrating the invention, there is shown in the drawings, embodiments which are present preferred. It should be understood, however, that the present invention is not limited to the precise arrangements and instrumentality shown in the attached drawings.

DETAILED DESCRIPTION OF THE INVENTION

Figure 1:
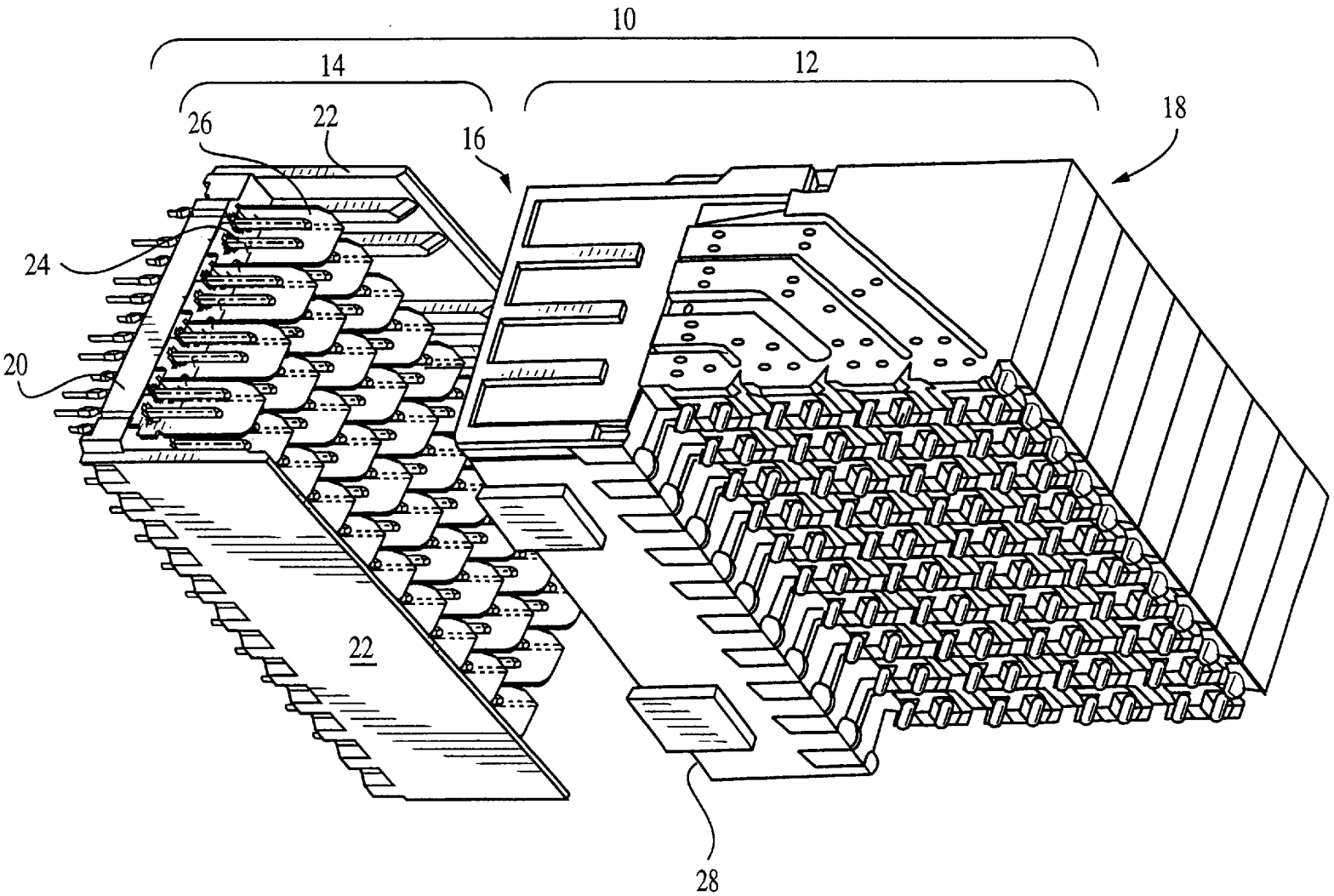
FIG. 1 illustrates an isometric view of a connector assembly formed in accordance with a preferred embodiment of the present invention.

FIG. 1 illustrates a connector assembly 10 including a receptacle 12 and a header 14. An insulated housing 16 is provided as part of the receptacle 12. Multiple terminal modules 18 (also referred to as chicklets) are mounted in the insulated housing 16. The header 14 includes a base 20 and sidewalls 22. The base 20 retains an array or matrix of header contacts 24 and header contact ground shields 26. By way of example only, the header contacts 24 may be formed as rectangular pins. The insulated housing 16 includes a mating face 28 having a plurality of openings therein aligned with the header contacts 24 and header contact ground shields 26. The header contact ground shields 26 and header contacts 24 are joined with receptacle contacts and receptacle grounds contained in the terminal modules. 18 (as explained in more detail below).

Figure 2:
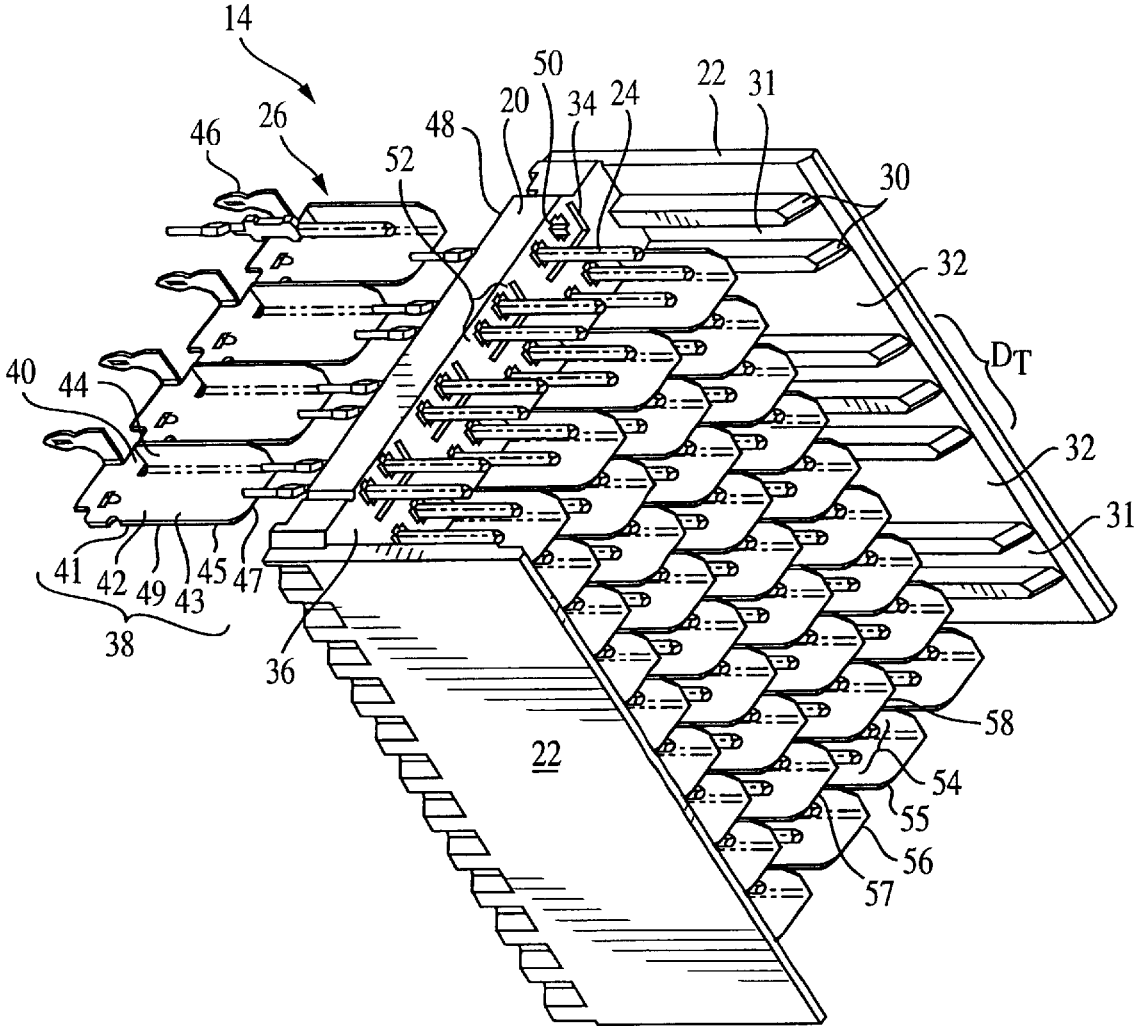
FIG. 2 illustrates an exploded isometric view of a header, header contacts and header ground shields formed in accordance with a preferred embodiment of the present invention.

FIG. 2 illustrates an isometric view of a header 14 in more detail. The sidewalls 22 include a plurality of ribs 30 formed on the interior surfaces thereof. Gaps 31 are formed between the ribs 30 as part of a void core manufacturing process. Void coring may be used to avoid the formation of sink holes in the sidewalls 22. Groups of ribs 30 may be separated by large gaps to form guide channels 32 that are used to guide the header 14 and receptacle 12 onto one another. The guide channels 32 may also be formed with different widths in order to operate as a polarizing feature to ensure that the receptacle 12 is properly oriented before mating with the header 14.

The base 20 of the header 14 includes a plurality of L-shaped notches 34 cut there through. The L-shaped notches 34 are aligned in rows and columns to define a matrix across the mating face 36 of the header 14. The mating face 36 abuts against the mating face 28 on the receptacle 12 when the connector assembly 10 is fully joined. The header 14 receives a plurality of ground shield segments 38, each of which includes four header contact ground shields 26 (in the example of FIG. 2). A ground shield segment 38 may be stamped from a single sheet of metal. Jumper straps 40 join the four header contact ground shields 26. Each header contact ground shield 26 includes a blade portion 42 and a leg portion 44 bent to form an L-shape. Ground shield contacts 46 are stamped from the same piece of metal as the remainder of the ground shield segment 38 and are integral with the four header contact ground shields 26. While not illustrated in FIG. 2, slots are provided along the rear surface 48 of the base 20 between notches 34 to receive the jumper straps 40 until flush with the rear surface 48. The slots between the notches 34 do not extend fully through the base 20 to the mating face 36. The blades 42 includes a front surface 43 and a rear surface 45, and base 41, an intermediate portion 49, and tip 47. The base 41 is formed with the jumper straps 40. The tip 47 extends beyond the outer end of the header contacts 24.

The base 20 also includes a plurality of header contact holes 50 cut there through. The header contact holes 50, in the example of FIG. 2, are arranged in pairs 52 in order to receive corresponding pairs of header contacts 24. Each pair 52 of holes 50 is located in the interior of a corresponding L-shaped notch 34 such that the associated pair of header contacts 24 are shielded on two sides by the blade portion 42 and leg portion 44 of the corresponding contact ground shields 26. By configuring the contact ground shields 26 to partially enclose each pair of header contacts 24, each pair of header contacts 24 is substantially surrounded on all sides by contact ground shields 26. By way of example, header contact pair 54 may be surrounded by blade and/or leg portions of contact ground shields 55–58. The contact ground shields 26 surround each pair of header contacts 24 to control the operating impedance of the connector assembly 10 when carrying high frequency signals.

Figure 3:
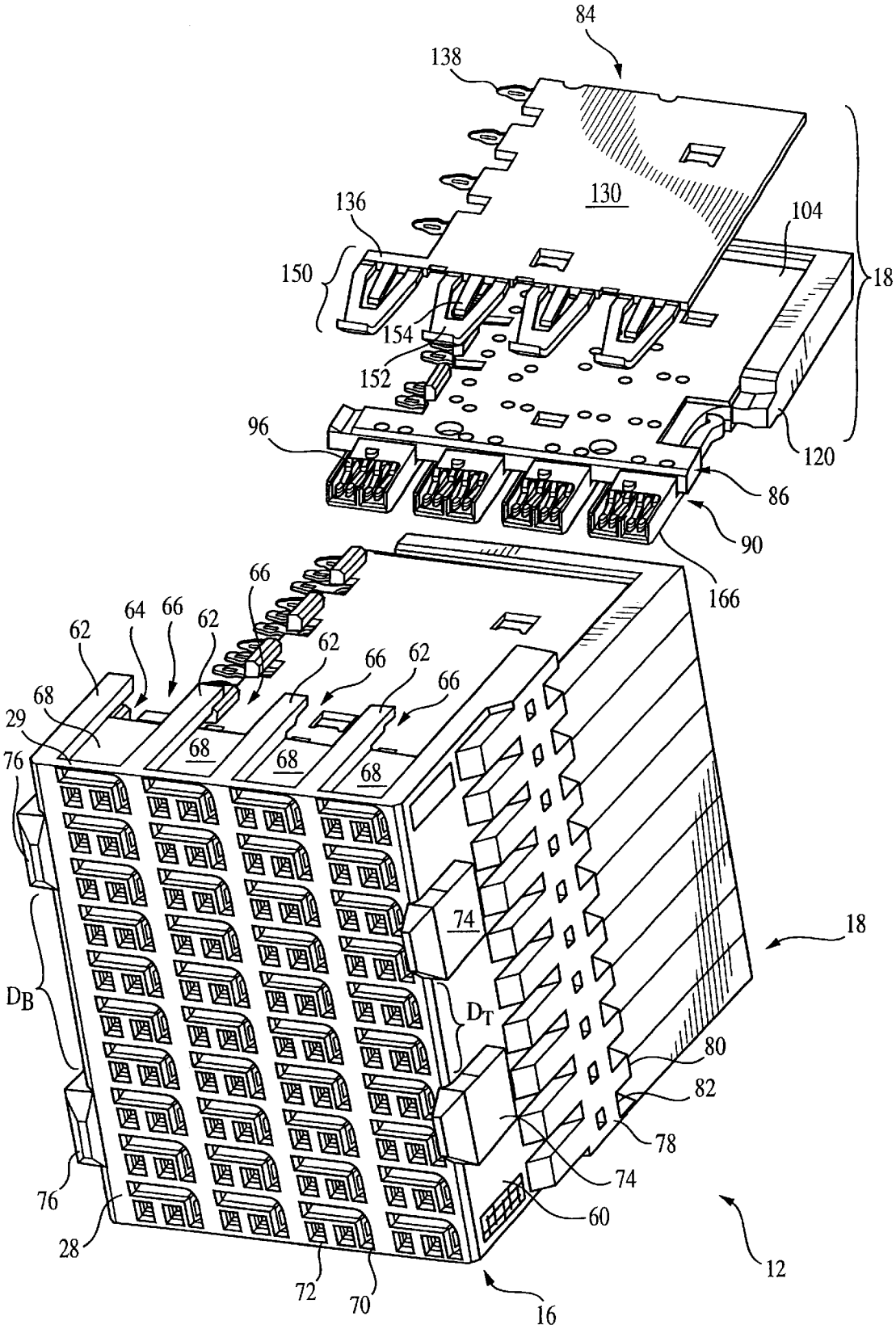
FIG. 3 illustrates an exploded isometric view of a receptacle formed in accordance with a preferred embodiment of the present invention.

FIG. 3 illustrates a receptacle 12, from which one terminal module 18 has been removed and partially disassembled. The receptacle 12 includes an insulated housing 16 formed with a mating face 28. The mating face 28 on the receptacle 12 is formed with a plurality of L-shaped notches 70 and contact receiving holes 72. The notches 70 and holes 72 are aligned to receive the contact ground shields 26 and header contacts 24 (FIG. 2).

A plurality of support posts 62 project rearward from the mating face 28 of the base 29 of the housing 16. The insulated housing 16 includes a top wall 60 formed with, and arranged to extend rearward from, the base 29. The top wall 60 and support posts 62 cooperate to define a plurality of slots 64, each of which receives one terminal module 18. The insulated housing 16 includes a plurality of top and bottom keying projections 74 and 76, respectively. The top keying projections 74 are spaced a distance $D_T$ apart from one another, while the bottom keying projections 76 are spaced a distance $D_B$ from one another. The distances $D_T$ and $D_B$ differ to distinguish the top and bottom keying projections 74 and 76 from one another. The keying projections 74 and 76 are received within the guide channels 32 (FIG. 2) located on the interior surfaces of the sidewalls 22 of the header 14. Both sidewalls 22 include ribs 30 and guide channels 32. The guide channels 32 viewable in FIG. 2 are spaced a distance $D_T$ from one another. While not illustrated in FIG. 2, similar guide channels are provided on the interior side of the opposite sidewall 22, but are spaced from one another by a distance $D_B$ to align with bottom keying projections 76.

The top wall 60 also includes a module support bracket 78 extending along a width of the top wall 60. The rear end 80 of the module support bracket 78 includes a plurality of notches 82 formed therein to receive upper ends of the terminal modules 18. Locking features are provided on the lower surface of the module support bracket 78 to secure the terminal modules 18 in place. The support posts 62 are formed in rows and columns. By way of example, the receptacle 12 in FIG. 3 illustrates four support posts 62 formed in each row, while the groups of four support posts 62 are provided in 11 columns. The support posts 62 define 10 slots 64 that receive 10 terminal modules 18. The support posts 62 and top wall 60 are spaced apart from one another to form, along each row of support posts 62, a series of gaps 66. In the example of FIG. 3, four gaps 66 are provided along each row of support posts 62. The gaps 66 between the support posts 62 and between the support posts 62 and top wall 60 are filled with thin insulating walls 68 that operate as a dielectric to cover open side on the terminal module 18 as explained below in more detail.

Figure 4:
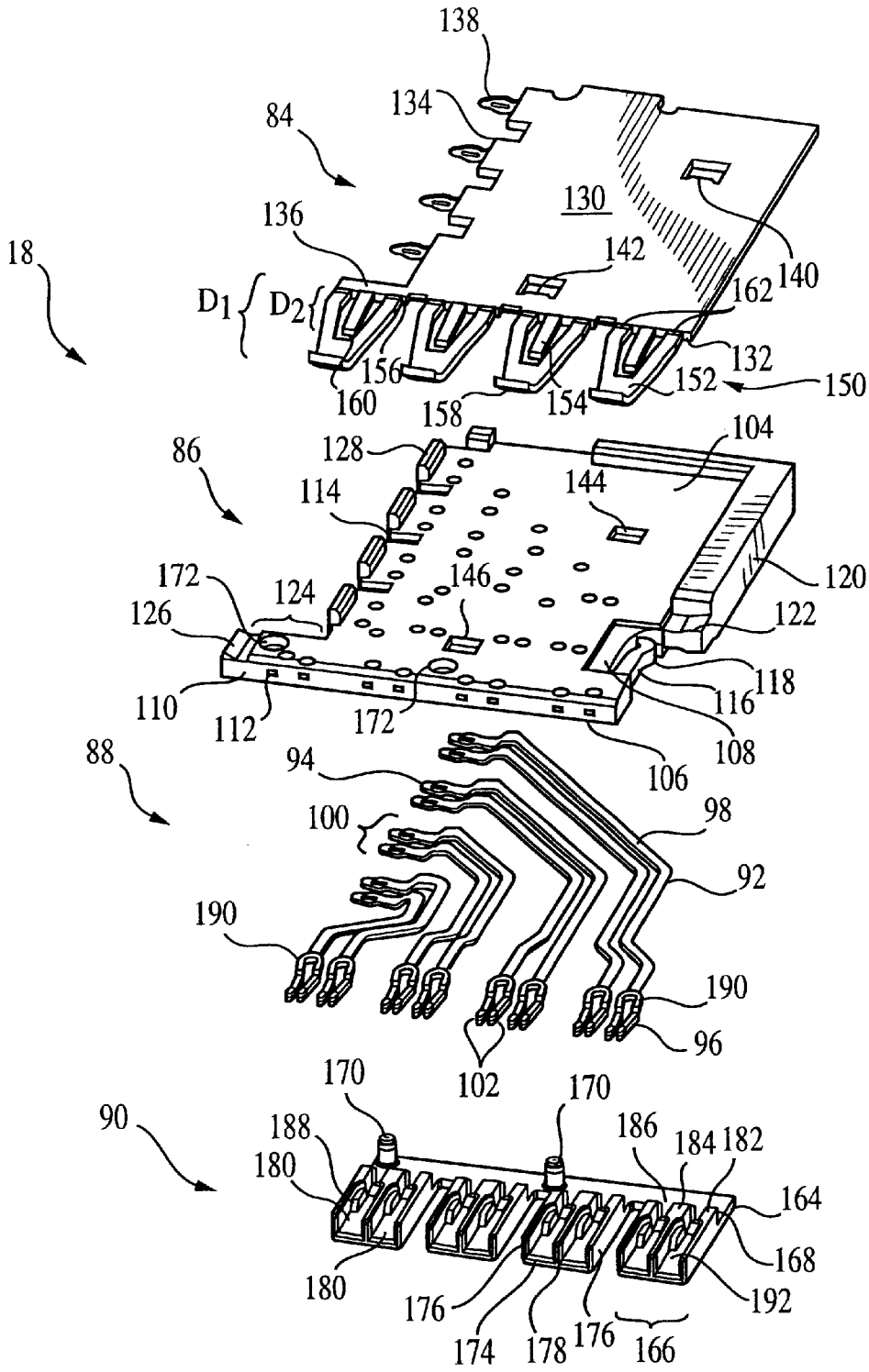
FIG. 4 illustrates an exploded isometric view of a terminal module formed in accordance with at least one preferred embodiment of the present invention.

FIG. 4 illustrates a terminal module 18 separated into its component parts. The terminal module 18 includes a module ground shield 84 that is mounted to a plastic over molded portion 86. The over molded portion 86 retains a lead frame 88. A cover 90 is mounted to one end of the over molded portion 86 to protect the receptacle contacts 96 that are located along one end of the lead frame 88. The lead frame 88 is comprised of a plurality of leads 92, each of which includes a board contact 94 and a receptacle contact 96. Each board contact 94 and corresponding receptacle contact 96 is connected through an intermediate conductive trace 98. By way of example, the leads 92 may be arranged in lead differential pairs 100. In the example of FIG. 4, four lead differential pairs 100 are provided in each terminal module 18. By way of example only, the receptacle contacts 96 may be formed in a "tuning fork" shape with opposed fingers 102 biased toward one another. The fingers 102 frictionally and conductively engage a corresponding header contact 24 when the receptacle 12 and header 14 are fully mated. The board contacts 94 may be inserted into corresponding slots in a computer board and connected with associated electrical traces.

The over molded portion 86 includes top and bottom insulated layers 104 and 106 that are spaced apart from one another to define a space 108 there between in which the lead frame 88 is inserted. The over molded portion 86 includes a front edge 110 having a plurality of openings 112 therein through which the receptacle contacts 96 project. The over molded portion 86 also includes a bottom edge 114 having a similar plurality of openings (not shown) through which the board contacts 94 extend. A latch arm 116 is provided along the top of the over molded portion 86. The latch arm 116 includes a raised ledge 118 on the outer end thereof to snappily engage a corresponding feature on the interior surface of the module support bracket 78. The over molded portion 86 includes an L shaped bracket 120 located along the top edge thereof and along the back edge to provide support and rigidity to the structure of the terminal module 18. The bracket 120 includes a V-shaped wedge 122 on a front end thereof. The V-shaped wedge 122 is slidably received within a corresponding inverted V-shape within the notches 82 in the module support bracket 78. The wedges 122 and notches 82 cooperate to insure precise alignment between the terminal module 18 and the insulated housing 16.

The terminal module 18 also includes an extension portion 124 proximate the front edge 110 and extending downward beyond the bottom edge 114. The extension portion 124 projects over an edge of a board upon which the terminal module 18 is mounted and into which the board contacts 94 are inserted. The outer end of the extension portion 124 includes a wedge embossment 126 extending outward at least along one side of the extension portion 124. The embossment 126 is received within a corresponding notch formed between adjacent support posts 62 along the bottom of the insulated housing 16 to insure proper alignment between the terminal module 18 and the insulated housing 16. The over molded portion 86 includes a series of projections 128 extending upward from the bottom edge 114. The projections 128 and bracket 120 cooperate to define a region in which the module ground shield 84 is received. The module ground shield 84 is mounted against the top layer 104 of the over molded portion 86. The module ground shield 84 includes a main body 130, with a front edge 132 and a bottom edge 134. An extended ground portion 136 is arranged along the front edge 132 and projects downward below the bottom edge 134. The extended ground portion 136 overlays the extension portion 124 to reside along an end of a board upon which the terminal module 18 is mounted. The bottom edge 134 includes a plurality of board grounding contacts 138 that conductably connect the module ground shield 84 to grounds on the board. The main body 130 includes two latching members 140 and 142,that extend through holes 144 and 146, respectively, in the top layer 104. The latch members 140 and 142 secure the module ground shield 84 to the over molded portion 86.

The module ground shield 84 includes a plurality of ground contact assemblies 150 mounted to the front edge 132. Each ground contact assembly 150 includes a primary ground contact 152 and a secondary ground contact 154. Each ground contact assembly 150 is mounted to the main body 130 through a raised ridge 156. The primary ground contacts 152 include outer ends 158 that are located a distance $D_1$ beyond the front edge 132. The secondary ground contacts 154 include an outer end 160 located a distance $D_2$ beyond the front edge 132. The outer end 158 of the primary ground contacts 152 is located further from the front edge 132 than the outer end 160 of the secondary ground contacts 154. In the example of FIG. 4, the primary ground contacts are V-shaped with an apex of the V forming the outer end 158, and base of the V-shape forming legs 162 that are attached to the main body 130. The tip of the outer ends 158 and 160 may be flared upward to facilitate engagement with the header contact ground shields 26.

The cover 90 includes a base shelf 164 and multiple differential shells 166 formed therewith. The base shelf 164 is mounted to the bottom layer 106 of the over molded portion 86, such that the rear end 168 of the differential shells 166 abut against the front edge 110 of the over molded portion 86. Mounting posts 170 on the cover 90 are received within holes 172 through the top and bottom layers 104 and 106. The mounting posts 170 may be secured to the holes 102 in a variety of manners, such as through a frictional fit, with adhesive and the like. Each differential shell 166 includes a floor 174, sidewalls 176 and a center wall 178. The side and center walls 176 and 178 define channels 180 that receive the receptacle contacts 96. The rear ends of the sidewalls 176 and center walls 178 include flared portions 182 and 184 that extend toward one another but remain spaced apart from one another to define openings 186 there between. Ramp blocks 188 are provided along the interior surfaces of the sidewalls 176 and along opposite sides of the center walls 178 proximate the rear ends thereof. The ramped blocks 188 support corresponding ramped portions 190 on the receptacle contacts 96.

Each terminal module 18 includes a cover 90 having at least one differential shroud or shell 166 enclosing an associated differential pair of contacts 96. Each shroud or shell 166 may have at least one open face (e.g., open top side 192) exposing one of the top and bottom sides of the contacts 96. As a further alternative, the terminal module 18 may include multiple differential shrouds or shells 166 receiving corresponding differential pairs of contacts 96. Each shroud or shell 166 may include a floor 174, sidewalls 176, and a center wall 178 to form separate channels 180 to closely retain each receptacle contact 96. The floor 174, sidewalls 176 and center wall 178 have interior surfaces forming a curved contour that closely follows and conforms to the exterior surfaces of the contacts 96, in order to minimize the distance and air gap between the shell 166 and contacts 96.

The side walls 176, center wall 178, flared portions 182 and 184, and ramp blocks 188 define a cavity comprising the channel 180 and opening 186. The channel 180 includes open front and rear ends and one open side. The cavity closely proximates the shape of the fingers 102 on receptacle contacts 96. The walls of the cavity are spaced from the receptacle contacts 96 by a very narrow gap, such as approximately 0.1 mm. Hence, the contour of the-cavity walls closely matches the contour of the receptacle contacts 96, thereby minimizing impedance and enhancing the electrical performance.

The differential shells 166 include at least one open side. In the example of FIG. 4, each differential shell 166 includes an open top side 192. The top side 192 is maintained open to enhance electrical performance, specifically by controlling the impedance, by enabling the receptacle contacts 96 to be inserted into the cover 90 in a manner in which the fingers 102 of each receptacle contact 96 are closely spaced to the sidewalls 176, center wall 178, flared portions 182 and 184, and ramped portions 190. The open top side 192 is maintained opened to enable the receptacle contacts 96 to be inserted into the differential shells 166 in a manner having a very close tolerance. Optionally, the floor 174 may be open and the top side 192 closed. The insulated walls 68 on the housing 16 close the open top sides 192 of each differential shell when the terminal modules 18 are inserted into the housing 16 (or open floor 174 if used).

When a receptacle 96 is located in a channel 180, the attached lead 92 extends through opening 186 in the rear end of the differential shell 166. The fingers 102 engage a corresponding header contact 24 through the open front end of the differential shell 166. The open top side 192 is covered by insulating wall 68 when the terminal module 18 is inserted into the housing 16.

The contour of the cavity and the close tolerance achieved when the receptacle contacts 96 are inserted into the differential shells 166 enhances the electrical performance of the terminal module 18, and therefore the connector assembly 10. That is, because the side walls 176, center wall 178, flared portions 182 and 184, and ramp blocks 188 define a cavity comprising the channel and opening 186 that closely proximates the shape of the fingers 102 on the receptacle contacts 96, a relatively small amount of air surrounds the fingers 102 of the receptacle contacts 96 when the receptacle contacts 96 are inserted into the differential shells 166.

The amount of air that surrounds the fingers 102 of the receptacle contacts 96 is less than if the cavity were cube-shaped, or another non-curved shape that did not conform to the contours of the fingers 102 of the receptacle contacts 96. Less air surrounds the receptacle contacts 96 because the cavity conforms to the contours of the fingers 102 of the receptacle contacts 96, and a close tolerance is achieved when the receptacle contacts 96 are inserted into the differential shells 166. The insulated walls 68 on the housing 16 close the open top sides 192 of each differential shell 166 when the terminal modules 18 are inserted into the housing 16 thereby keeping airflow within the cavity to a minimum. Because less air surrounds the fingers 102 of the receptacle contacts 96, impedance is kept within manageable limits. Consequently, the electrical performance of the connector assembly 10 is enhanced.

Figure 5:
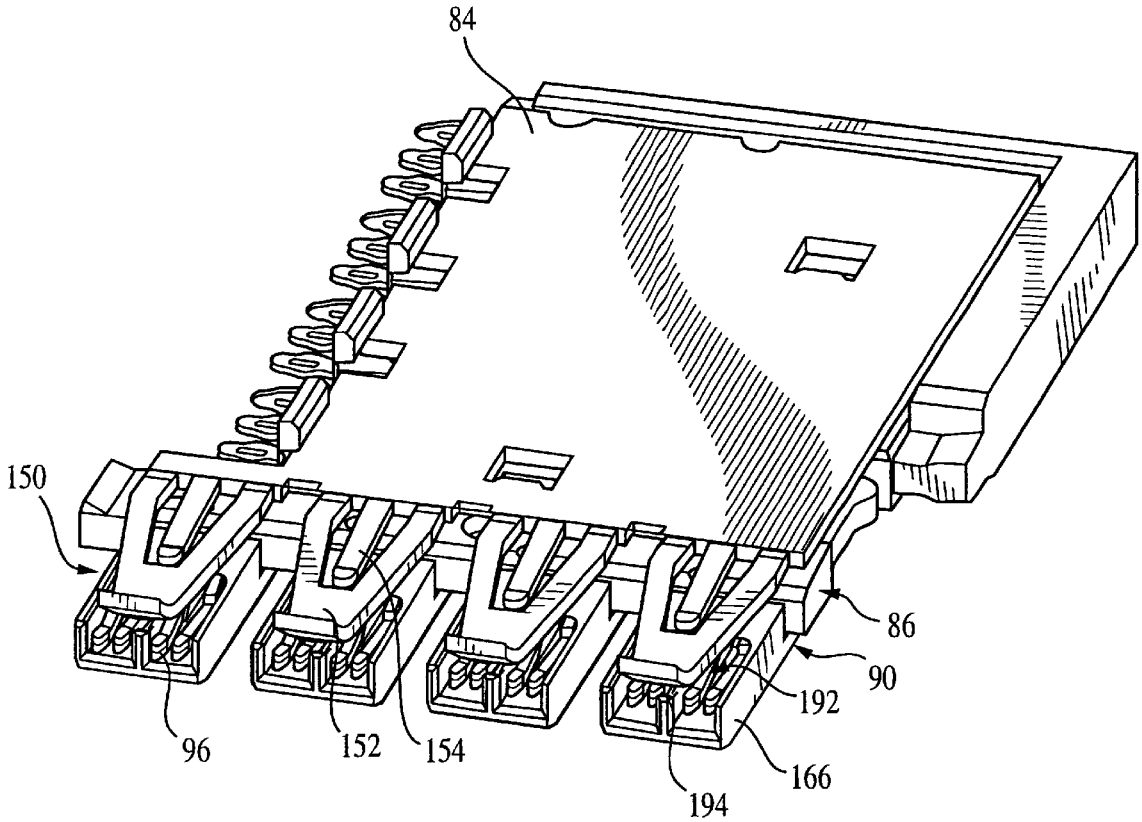
FIG. 5 illustrates an isometric view of a terminal module formed in accordance with a preferred embodiment of the present invention.

FIG. 5 illustrates a terminal module 18 with the module ground shield 84 fully mounted upon the over molded portion 86. The cover 90 is mounted to the over molded portion 86. The ground contact assemblies 150 are located immediately over the open top sides 192 of each differential shell 166 with a slight gap 194 there between. The primary and secondary ground contacts 152 and 154 are spaced a slight distance above the receptacle contacts 96.

Figure 6:
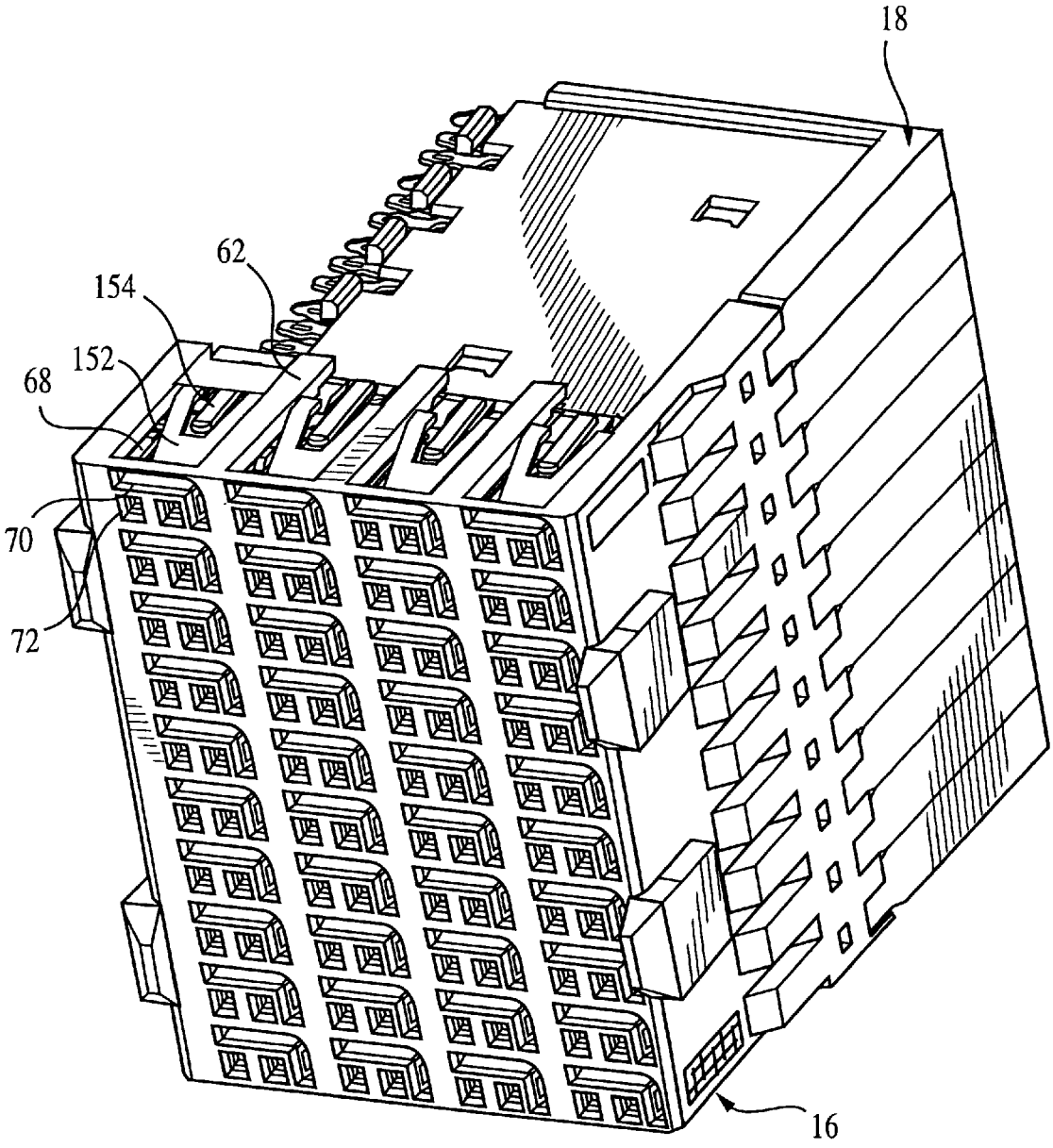
FIG. 6 illustrates an isometric view of a receptacle formed in accordance with a preferred embodiment of the present invention.

As illustrated in FIG. 6, when the terminal module 18 is inserted into the insulated housing 16, the insulated walls 68 are slid along gaps 194 between the ground contact assemblies 150 and receptacle contacts 96. By locating the insulated walls 68 over the open top sides 192 of each differential shell 166, the connector assembly 10 entirely encloses each receptacle contact 96 within an insulated material to prevent arching between receptacle contacts 96 and the ground contact assemblies 150. Once the terminal modules 18 are inserted into the insulated housing 16, the primary and secondary ground contacts 152 and 154 align with the L-shaped notches 70 cut through the mating face 28 on the front of the insulated housing 16. The receptacle contacts 96 align with the contact receiving holes 72. When interconnected, the header contact ground shields 26 are aligned with and slid into notches 70, while the header contacts 24 are aligned with and slid into contact receiving holes 72.

As the header contact ground shields 26 are inserted into the notches 70, the primary ground contact 152 initially engages the tip 47 of the rear surface 45 of a corresponding blade portion 42. The primary ground contacts 15.2 are dimensioned to engage the tip 47 of the header contact ground shield 26 before the header and receptacle contacts 24 and 96 touch to prevent shorting and arching. As the header contact ground shields 26 are slid further into the notches 70, the tips 47 of the blade portions 42 engage the outer ends 160 of the secondary ground contact 154 and the outer ends 158 of the primary ground contacts 152 engage the intermediate portion 49 of the black portion 42. When the receptacle 12 and header 14 are in a fully mated position, the outer end 158 of each primary ground contact 152 abuts against and is in electrical communication with a base 41 of a corresponding blade portion 42, while the outer end 160 of the secondary ground contact 154 engages the blade portion 42 at an intermediate point 49 along a length thereof Preferably, the outer end 160 of the secondary ground contact 154 engages the blade portion 42 proximate the tip 47 thereof.

The primary and secondary ground contacts 152 and 154 move independent of one another to separately engage the header contact ground shield 26. By engaging the header contact ground shield 26 at an intermediate portion 49 with the secondary ground contact 154, the header contact ground shield 26 does not operate as a stub antenna and does not propagate EM interference. Optionally, the outer end 160 of the secondary ground contact 154 may engage the header contact ground shield 26 at or near the tip 47 to further prevent EM interference. The length of the secondary ground contacts 154 effects the force needed to fully mate the receptacle 12 and header 14. Thus, the secondary ground contacts 154 are of sufficient length to reduce the mating force to a level below a desired maximum force. Thus in accordance with at least one preferred embodiment, the primary ground contacts 152 engage the header contact ground shield 26 before the header and receptacle contacts 24 and 96 engage one another. The secondary ground contact 154 engage the header contact ground shields 26 as close-as preferable to the tip 47, thereby minimizing the stub antenna length without unduly increasing the mating forces.

Optionally, the ground contact assembly 150 may be formed on the header 14 and the ground shields 26 formed on the receptacle 12. Alternatively, the ground contact assemblies 150 need not include v-shaped primary ground contacts 152. For example, the primary ground contacts 152 may be straight pins aligned side-by-side with the secondary ground contacts 154. Any other configuration may be used for the primary and secondary contacts 152 and 154 so long as they contact the ground shields 26 at different points.

Additional inventive features of the connector assembly are described in more detail in a co-pending application (Tyco Docket Number 17615) filed on the same day as the present application and entitled "Connector Assembly With Multi-Contact Ground Shields." The co-pending application names Robert Scott Kline as the sole inventor and is assigned to the same assignee as the present application and is incorporated by reference herein in its entirety including the specification, drawings, claims, abstract and the like.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A terminal module mountable to an insulated housing of an electrical connector, said terminal module comprising:

receptacle contacts and leads connected thereto for carrying signals through the terminal module; and a differential shell including a floor, sidewalls and a center wall defining open-sided chambers that receive said receptacle contacts, each open-sided chamber having open front and open rear ends and having at least one open side, said open-sided chambers accepting corresponding receptacle contacts through said open sides, said walls of said differential shells having a non-linear contour substantially conforming to a contour of said receptacle contacts, at least one of said floor, sidewalls and center well includes a non-linear, curved surface following a contour of a corresponding surface of an associated receptacle contact.

2. The terminal module of claim 1, wherein said differential shell includes an open top side.

3. The terminal module of claim 1, wherein said chamber includes interior surfaces forming a curved contour that closely follows and substantially conforms to exterior surfaces of said receptacle contacts.

4. The terminal module of claim 1, wherein said receptacle contacts are formed in a fork shape with a flared base and fingers located closer one another than said flared base, said walls of said differential shell substantially conforming to outer surfaces of said fingers.

5. A terminal module mountable to an insulated housing of an electrical connector, said terminal module comprising:

a differential shell having an open-sided cavity therein; and receptacle contacts having exterior surfaces that conform to interior surfaces of said open-sided cavity, wherein said differential shell includes a floor, sidewalls, a center wall, flared portions and ramp blocks defining a contour of said open-sided cavity, said sidewalls having projections formed on interior surfaces thereof formed to cooperate with said sidewalls to substantially conform to a contour of said receptacle contacts.

6. The terminal module of claim 5 wherein said sidewalls and said center wall are spaced less than 0.15 mm away from said receptacle contacts upon receipt of said receptacle contacts by said differential shell.

7. The terminal module of claim 5 further including a lead frame, wherein said lead frame includes conductive leads arranged in at least two differential pairs of leads, each lead having board contacts and receptacle contacts at opposite ends thereof, said receptacle contacts and said board contacts being interconnected through intermediate conductive portions.

8. The terminal module of claim 5 further including a lead frame, wherein said lead frame includes four differential pairs of conductive leads, each conductive lead having board contacts and receptacle contacts at opposite ends thereof, said receptacle contacts and said board contacts being interconnected through intermediate conductive portions.

9. The terminal module of claim 5 including an insulated body enclosing multiple signal conductors with board contacts and receptacle contacts on opposed ends, said signal conductors and said contacts being formed in differential pairs.

10. The terminal module of claim 5 wherein said receptacle contacts are inserted into said differential shell through an open side to enhance electrical performance by enabling said receptacle contacts to be closely spaced to inner surfaces of said open-sided cavity.

11. The terminal module of claim 5, wherein said receptacle contact is located at a terminal end of a lead passing through an open rear end of said differential shell.

12. The terminal module of claim 5, wherein said receptacle contacts include fingers that are biased toward one another in the shape of a tuning fork.

13. An electrical connector assembly having a receptacle connector mateable with a header connector operable in at least differential pair applications, comprising:

an insulated housing; and a plurality of terminal modules mountable to said insulated housing, each terminal module having an insulated body enclosing multiple signal conductors with signal contacts on opposed ends, said signal conductors and contacts being formed in differential pairs, said terminal module including:

a plurality of open-sided differential shells formed within said terminal module; and receptacle contacts that conform to an inner cavity within a differential shell, each differential shell having walls with non-linear interior surfaces that define an open-sided cavity conforming to a contour of said receptacle contacts, and said open-sided cavity including a floor, sidewalls, a center wall, flared portions and ramp blocks defining a contour of said open-sided cavity.

14. The electrical connector assembly of claim 13, wherein said differential shell receives said receptacle contacts through an open side of said cavity.

15. The electrical connector assembly of claim 13, wherein said insulated housing includes insulated walls that close open sides of said open-sided differential shells when said terminal module is inserted into said insulated housing.

16. The electrical connector assembly of claim 13, further including module ground shields mounted to and located between said terminal modules, each module ground shield including at least one ground contact assembly located proximate said receptacle contacts, said ground contact assembly including a primary ground contact extending a first distance from said ground shield and a secondary ground contact extending a second distance from'said ground shield.

17. The electrical connector assembly of claim 13, wherein said insulated housing includes a plurality of support posts that cooperate to define a plurality of slots, each slot of which receives one of said terminal modules, said support posts are spaced apart from one another to form, along each row of support posts, a series of gaps therebetween, said insulated housing including thin insulating walls filling said gaps between said support posts.

18. The electrical connector assembly of claim 13, wherein said insulated housing includes a plurality of support posts spaced apart from one another by gaps, thin insulated walls being formed between said support posts to fill said gaps, said thin insulating walls closing an open side of said differential shells.

19. The electrical connector assembly of claim 13, further comprising a plurality of ground terminals located immediately adjacent an open side of said differential shells, said insulated housing including insulating walls arranged to be accepted between said ground terminals and said open sides of said differential shells to form an insulative layer between said ground terminals and said receptacle contacts.

20. A terminal module mountable to an insulated housing of an electrical connector, said terminal module comprising:

receptacle contacts and leads connected thereto for carrying signals through the terminal module; and a differential shell including:

a floor, sidewalls and a center wall defining open-sided chambers that receive said receptacle contacts, each open-sided chamber having open front and open rear ends and having at least one open side, said open-sided chambers accepting corresponding receptacle contacts through said open sides, said walls of said differential shell having a non-linear contour substantially conforming to a contour of said receptacle contacts, at least one of said floor, sidewalls and center wall includes a non-linear, curved surface following a contour of a first corresponding surface of an associated receptacle contact; and flared portions and ramp blocks defining a contour of each open-sided chamber.

* * * * *